US005982262A

United States Patent [19]

Levin

[11] Patent Number: 5,982,262

[45] Date of Patent: Nov. 9, 1999

[54] PHASE SHIFTING TRANSFORMER WITH LOW ZERO PHASE SEQUENCE IMPEDANCE

[76] Inventor: Michael I. Levin, 33 Bayhampton Court, North York, Ontario, Canada, M3H 5L5

[21] Appl. No.: 08/986,831

[22] Filed: Dec. 8, 1997

Related U.S. Application Data

[63] Continuation of application No. 08/230,466, Apr. 20, 1994, Pat. No. 5,801,610.

[51] Int. Cl.[6] ..... H01F 30/12; H01F 30/14

[52] U.S. Cl. ..... 336/5; 336/10; 336/12

[58] Field of Search ..... 336/5, 10, 12

[56] References Cited

U.S. PATENT DOCUMENTS 5,206,539 4/1993 Kammeter ..... 336/5

FOREIGN PATENT DOCUMENTS 1408359 7/1964 European Pat. Off. ..... 336/5

*Primary Examiner*—Michael L. Gellner
*Assistant Examiner*—Anh Mai
*Attorney, Agent, or Firm*—Dimock Stratton Clarizio; Mark B. Eisen

[57] ABSTRACT

A phase shifting transformer or autotransformer for a three phase power distribution network in which selected outputs have a low zero phase sequence impedance. At least one low zero phase sequence impedance output is fed by a plurality of windings distributed amongst the three core legs such that the number of turns of windings generating a flux in the positive direction is substantially equal to the number of turns of windings generating a flux in the negative direction. Thus, according to the invention, the transformer may be provided with any necessary phase shifting angles between different harmonic sources, with some or all outputs having a low zero phase sequence impedance to reduce voltage distortion created by zero phase sequence harmonics.

24 Claims, 4 Drawing Sheets

PHASE SHIFTING TRANSFORMER WITH LOW ZERO PHASE SEQUENCE IMPEDANCE

This application is a continuation of U.S. patent application Ser. No. 08/230,466 filed Apr. 20, 1994, U.S. Pat. No. 5,801,610.

FIELD OF INVENTION

This invention relates to transformers and autotransformers for electrical distribution systems. In particular, this invention relates to a three-phase phase shifting transformer or autotransformer which reduces voltage distortion caused by zero phase sequence and conventional harmonic currents.

BACKGROUND OF THE INVENTION

Three-phase electrical distribution networks, for example distributing an electrical power supply through a building, are subject to harmonic currents generated by non-linear loads such as electronic equipment and equipment that uses different kinds of arc processes. Such equipment can generate excessive harmonic currents in the distribution network, including zero phase sequence (triplen) harmonics (3rd, 9th etc.) and conventional harmonics (5th, 7th, 11th, 13th, 17th, 19th etc.).

Zero phase sequence harmonics, together with unbalanced portions of the fundamental and other harmonic currents, are additive in the neutral conductor, which can result in cumulative currents well in excess of the anticipated phase currents and overload the neutral conductor, which is not protected. In addition to the possibility of overload, these harmonics result in high common-mode noise level (neutral to ground voltage), increased total harmonic distortion level, voltage imbalance, increased power losses and other problems which are well known.

Different kinds of L-C filters can be used in low voltage systems, tuned to different harmonic frequencies. These devices present problems which are well known.

In a three-phase distribution network, zero phase sequence harmonics are conventionally controlled using zero phase sequence filters. Such filters, for example so-called "zig-zag" reactors, have a low impedance to zero phase sequence currents and as such serve to attract these currents and effectively divert them from the distribution network. Because the two windings on each core leg have opposite polarities the zero phase sequence current fluxes generated by the windings on any particular core leg are opposite and therefore cancel. However, such filters do not reduce levels of conventional harmonics.

Different kinds of phase shifters are available which allow the creation of quasi-multiphase systems, reducing certain harmonic levels. Cancellation of certain harmonic currents generated by different loads depends upon the degree of phase shifting. However, these devices have a relatively high zero phase sequence impedance, and accordingly do not reduce voltage distortion levels created by zero phase sequence harmonic currents.

Combined zero phase sequence filters have recently become available, which reduce zero phase sequence harmonics and, by virtue of a 30° phase shift between the line and load sides of the filter, cancel or reduce 5th, 7th, 17th, 19th etc. harmonics. However, such devices do not reduce levels of 11th, 13th etc. harmonics. Moreover, this type of filter is directional, in that it has different impedances on different outputs; while this feature may be advantageous in some applications, in general it is preferable to have the lowest possible zero phase sequence impedance on all outputs.

The present invention overcomes these disadvantages by providing a three-phase phase shifting transformer or autotransformer with low zero phase sequence impedance. This is accomplished by interconnecting multiple windings in a secondary winding such that for each output having reduced zero phase sequence impedance the number of ampere-turns of windings creating fluxes in the positive direction is substantially equal to the number of ampere-turns of windings creating fluxes in the negative direction.

For at least one output having reduced zero phase sequence impedance the windings are distributed amongst all three core legs, one winding being oriented in one direction on the core and the other two windings being oriented in the other direction on the core, such that the total number of turns of the other two windings substantially equals the number of turns of the one winding. Thus, the present invention is able to create any necessary phase shifting angles between different harmonic sources, with some or all outputs each having a very low zero phase sequence impedance, so that the invention also acts as a zero phase sequence current filter. This significantly decreases power losses, partly because the cancellation of zero phase sequence fluxes in the core substantially reduces induced zero phase sequence harmonic currents in the primary, which reduces energy usage, avoids overheating and decreases voltage distortion.

These and other advantages will be apparent from the description of the invention which follows.

The present invention thus provides a phase shifting transformer or autotransformer for a three-phase power distribution network, comprising three core legs, and for each phase, a secondary winding comprising a plurality of windings electrically connected in series and distributed amongst the core legs, each secondary winding having at least two outputs for connection to one phase of the power distribution network, such that for at least one output each core leg is provided with at least one winding associated with said at least one output, wherein the number of turns of the windings and their placement and orientation on each core leg is such that, for each said at least one output, the total number of turns generating zero phase sequence flux in the positive direction substantially equals the total number of turns generating zero phase sequence flux in the negative direction.

The present invention further provides a phase shifting transformer or autotransformer for a three-phase power distribution network, comprising three core legs, and a secondary winding having at least two outputs for connection to each phase of the power distribution network, the secondary winding comprising a plurality of windings electrically connected in series and distributed amongst the core legs such that for at least one output each core leg is provided with at least one winding associated with said at least one output, wherein the number of turns of the windings associated with said at least one output and their orientation on the core is such that the total number of turns of windings associated with said at least one output generating zero phase sequence flux in the positive direction substantially equals the total number of turns of windings associated with said at least one output generating zero phase sequence flux in the negative direction.

The present invention further provides a phase shifting transformer or autotransformer for a three-phase power distribution network, comprising three core legs, and for each phase, a secondary winding comprising a plurality of windings electrically connected and distributed amongst the core legs, the secondary winding associated with at least one phase having at least two outputs for connection to one phase of the power distribution network, said at least two outputs having a phase shift no greater than 30 degrees, such that for at least one of said at least two outputs each core leg is provided with at least one winding associated with said at least one output, wherein the number of turns of the windings and their placement and orientation on each core leg is such that, for said at least one output, the total number of turns generating zero phase sequence flux in the positive direction substantially equals the total number of turns generating zero phase sequence flux in the negative direction.

BRIEF DESCRIPTION OF THE DRAWINGS

In drawings which illustrate by way of example only a preferred embodiment of the invention.

DETAILED DESCRIPTION OF THE INVENTION

The present invention provides a phase shifting transformer or autotransformer which also acts as a zero phase sequence current filter. For example, a transformer or autotransformer according to the present invention can be designed to provide a 30° phase shift between two outputs by providing a 15° leading phase displacement to one output and a 15° lagging phase displacement to the other output. In each case multiple windings are arranged on the core legs such that, for each phase, the sum of the flux vectors generated by windings connected in series results in the desired voltage and phase displacement. At the same time, for each output having a low zero phase sequence impedance the size (number of turns) of the windings and their placement and orientation on each core leg is such that, the total number of turns generating zero phase sequence flux in the positive direction substantially equals the total number of turns generating zero phase sequence flux in the negative direction. Thus, according to this arrangement, the phase shift results in cancellation of selected conventional harmonics and at the same time the distribution and orientation of the windings significantly reduces zero phase sequence harmonic fluxes, thus reducing voltage distortion created thereby.

Figure 1:
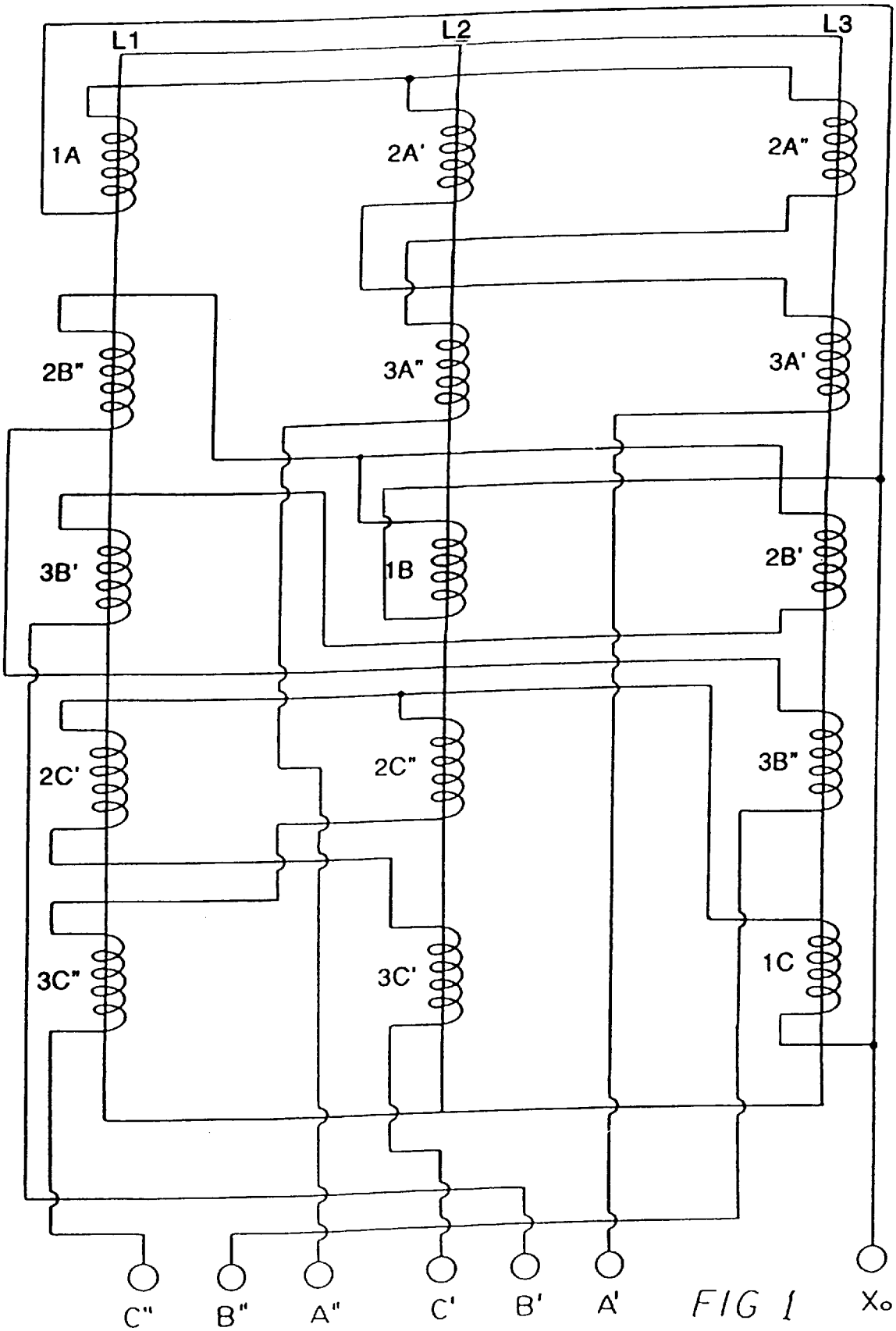
FIG. 1 is a schematic winding diagram of a transformer secondary embodying the invention with two outputs.

FIG. 1 illustrates a secondary for the transformer or autotransformer of the invention, having two three-phase outputs A', B', C' and A", B", C" provided with a 30° phase shift to reduce selected conventional harmonic currents (5th, 7th, 17th, 19th etc.), and at the same time each output has a low zero phase sequence impedance, significantly reducing voltage distortion created by zero phase sequence harmonics. The primary (not shown) may be of a conventional delta or star configuration. It will be appreciated that the invention is operable in both transformers and autotransformers, and although the description of the preferred embodiments refers to transformers by way of example, the construction and operating principles of the invention are equally applicable to autotransformers.

As illustrated in FIG. 1, the transformer secondary comprises a magnetic core having three core legs L1, L2 and L3 magnetically coupled to the primary in conventional fashion. Each core leg L1, L2, L3 is provided with a plurality of windings. The windings feeding each output are connected in series, the orientation and number of turns of each winding being selected according to the phase shift sought to be achieved, which in turn depends upon the harmonic currents sought to be reduced or eliminated. In the embodiment illustrated a phase displacement of 15° to each output results in a phase shift of 30° as between the two outputs.

Figure 2:
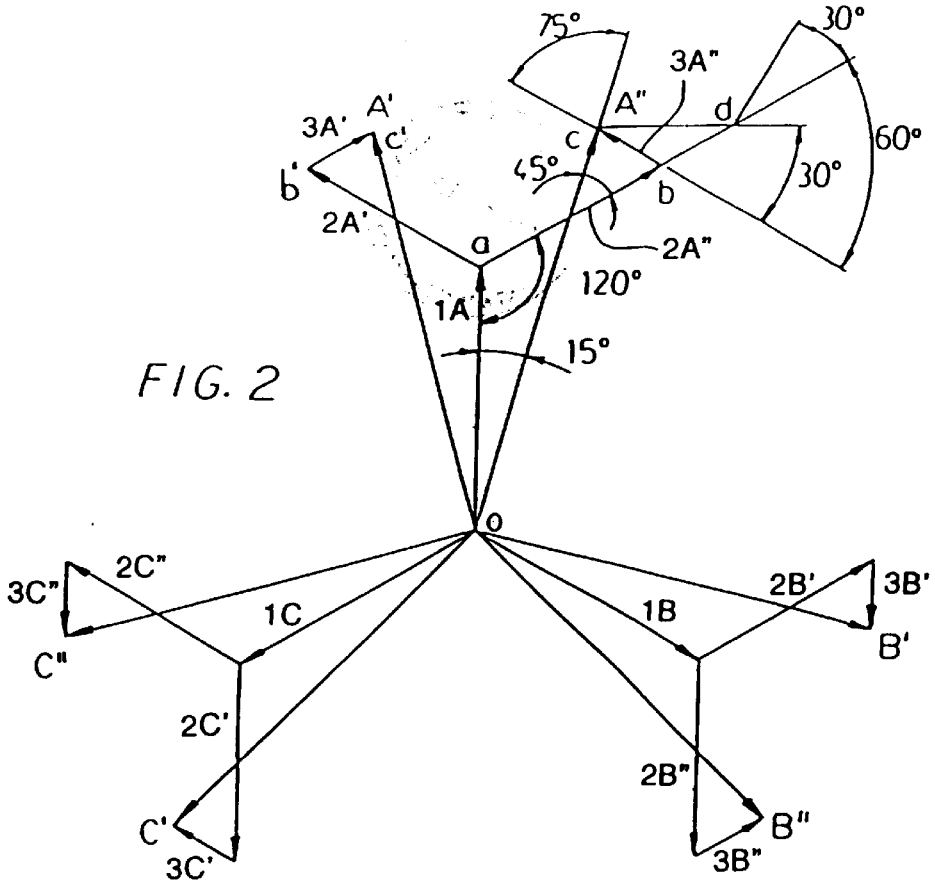
FIG. 2 is a vector diagram illustrating the e.m.f. of the transformer secondary of FIG. 1.

FIG. 2 is a vector diagram of the secondary for the phase shifting transformer (or autotransformer) of FIG. 1. The resultant vectors oA' and oA", oB' and oB", and oC' and oC" in FIG. 2 are the respective sums of the elementary vectors representing the voltages generated by each winding. The elementary flux vectors represent the intensity and direction of flux produced by the corresponding windings of FIG. 1.

Thus, as illustrated in FIG. 1, windings 1A, 2A' and 3A' are connected in series to produce output A'; windings 1A, 2A" and 3A" are connected in series to produce output A"; windings 1B, 2B' and 3B' are connected in series to produce output B'; windings 1B, 2B" and 3B" are connected in series to produce output B"; windings 1C, 2C' and 3C' are connected in series to produce output C'; and windings 1C, 2C" and 3C" are connected in series to produce output C". In the transformer of FIGS. 1 and 2 all outputs have a low zero phase sequence impedance, so each output is fed by three windings connected in series, one of said windings being disposed on each of the three core legs L1, L2 and L3. Taking output A' by way of example, one winding 1A is oriented in the positive direction while the other two windings 2A' and 3A' are oriented in the negative direction and together have the same number of turns as the winding 1A.

Figure 6:
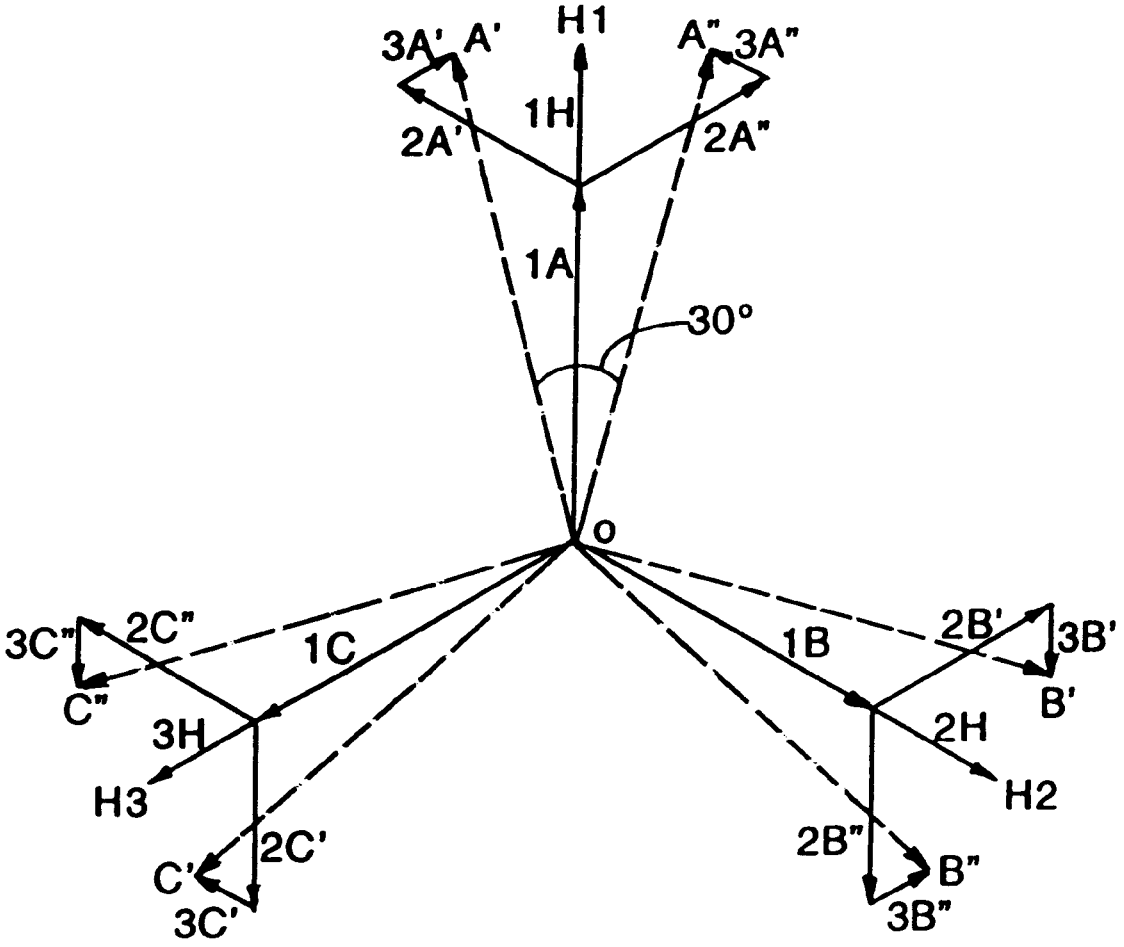
FIG. 6 is a vector diagram illustrating the e.m.f. of an autotransformer embodiment of the secondary of FIG. 1.

In the embodiment illustrated a single winding 1A, 1B or 1C is used for the initial elementary vector producing both outputs. For example, vector oa (see FIG. 2) is produced by a single winding 1A connected to two windings 2A' and 2A" to produce two separate outputs. In other words, the winding 1A is common to both outputs A' and A". It will be appreciated that two electrically independent windings could be used to produce vector oa, one winding connected to winding 2A" and the other connected to winding 2A", with exactly the same result but at a slight additional cost. Also, as illustrated in FIG. 6 an autotransformer embodiment of the transformer of FIGS. 1 and 2 involves essentially the same structure but with the addition of input windings 1H, 2H and 3H respectively coupled to input terminals H1, H2 and H3.

As is well known, the length of each flux vector is directly proportional to the number of ampere-turns in the corresponding winding, and the orientation of each flux vector is determined by the phase to which it is connected and the physical orientation of the winding on the core leg. The elementary flux vectors being generated by each of the three phases are limited to six directions: 0, 60, 120, 180, 240 and 300° (or, for purposes of simplicity, 0,+/−60,+/−120 and 180°). The size (number of turns N) of each winding determines the length of the flux vector. The phase connection and its orientation on the core leg determines its direction.

Thus, in order to obtain a phase shift of 30° between resultant vectors oA' and oA", the resultant vector oA" is phase shifted 15° lagging and the resultant vector oA' is phase shifted 15° leading (or, alternatively, one of the resultant vectors could be phase shifted 30° and the other resultant vector not phase shifted at all). The windings are of a size (number of turns) and orientation such that the sum of the elementary flux vectors oa+ab+bc equals the resultant vector oA" and the sum of the elementary flux vectors oa+ab'+b'c' equals the resultant vector oA'. This equation applies equally to the resultant vectors oB", oB' and oC", oC'.

The selection of possible combinations and permutations of flux vectors which will create each resultant vector, and thus achieve the desired phase shift to reduce conventional harmonic currents, is virtually unlimited. In order to significantly reduce or substantially eliminate zero phase sequence harmonic distortion at the same time, the sizes, orientations and locations of the windings on the core are also selected so that for each output having a low zero phase sequence impedance the total number of turns creating fluxes in the positive direction is equal to the total number of turns creating fluxes in the negative direction.

Accordingly, at least one output has a low zero phase sequence impedance and is fed by three windings: one winding oriented in one direction having a number of turns $N_1$, and the other two windings oriented in the other direction and having a number of turns $N_2$ and $N_3$ such that $N_1=N_2+N_3$. For each such output the number of turns of windings generating zero phase sequence fluxes in the positive direction equals the number of turns of windings zero phase sequence fluxes in the negative direction, so zero phase sequence fluxes cancel in the core and the output will have a low zero phase sequence impedance. To produce a phase shift as well, the number of turns $N_2$ and $N_3$ are selected to provide the desired phase shift angle.

Thus, the following equations are solved to produce a transformer represented by the vector diagram of FIG. 2:

$$V_{oa}=V_{ab}+V_{bc}$$

$$V_{cd}=2V_{bc}\cos 30°$$

$$V_{oc}=V_{oa}\cos 15°+V_{ab}\cos 45°+V_{bc}\cos 75°$$

$$V_{od}=V_{oc}\cos 15°+V_{cd}\cos 60°$$

$$V_{od}=2V_{oa}\cos 30°$$

In the transformer of FIG. 2 these equations yield:

$$oa=0.6439V_{oc}$$

$$ab=0.4714V_{oc}$$

$$bc=0.1725V_{oc}$$

Where $V_{oc}$ is the desired line-to-neutral voltage.

It can be seen by solving these equations that for each output having a low zero phase sequence impedance, the total number of turns creating fluxes in the positive direction is equal to the total number of turns creating fluxes in the negative direction.

Figure 3:
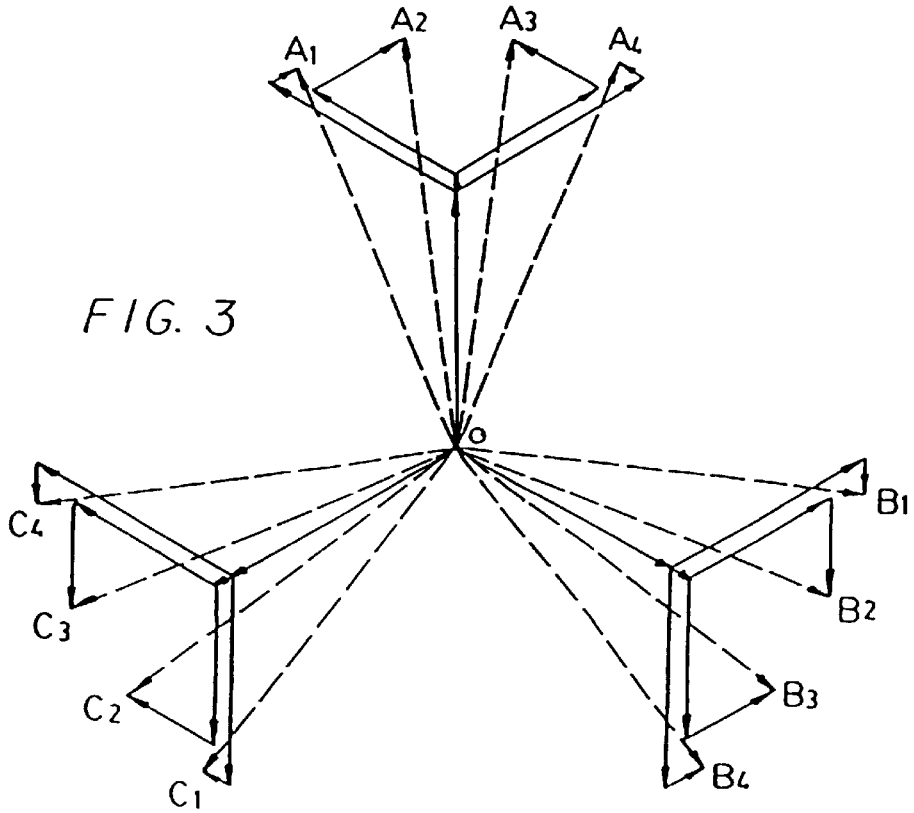
FIG. 3 is a vector diagram illustrating the e.m.f. of a transformer secondary embodying the invention with four outputs.

FIG. 3 illustrates an embodiment of the invention having four outputs. In this embodiment, resultant vectors $oA_2$ and $oA_3$ are phase shifted 15° relative to each other, based on leading and lagging phase displacements of 7.5°, respectively. Resultant vector $oA_1$ is phase shifted 15° (leading) relative to vector $oA_2$, and resultant vector $oA_4$ is phase shifted 15° (lagging) relative to vector $oA_3$. This phase shift to outputs $A_1$, $A_2$, $A_3$ and $A_4$ applies equally to outputs $B_1$, $B_2$, $B_3$ and $B_4$ and to outputs $C_1$, $C_2$, $C_3$ and $C_4$, respectively. The result is a four-output phase shifting transformer (or autotransformer) which cancels conventional (5th, 7th, 11th, 13th, 17th, 19th, etc.) harmonics and significantly reduces voltage distortion caused by zero phase sequence harmonics by providing each output with a low zero phase sequence impedance.

Figure 4:
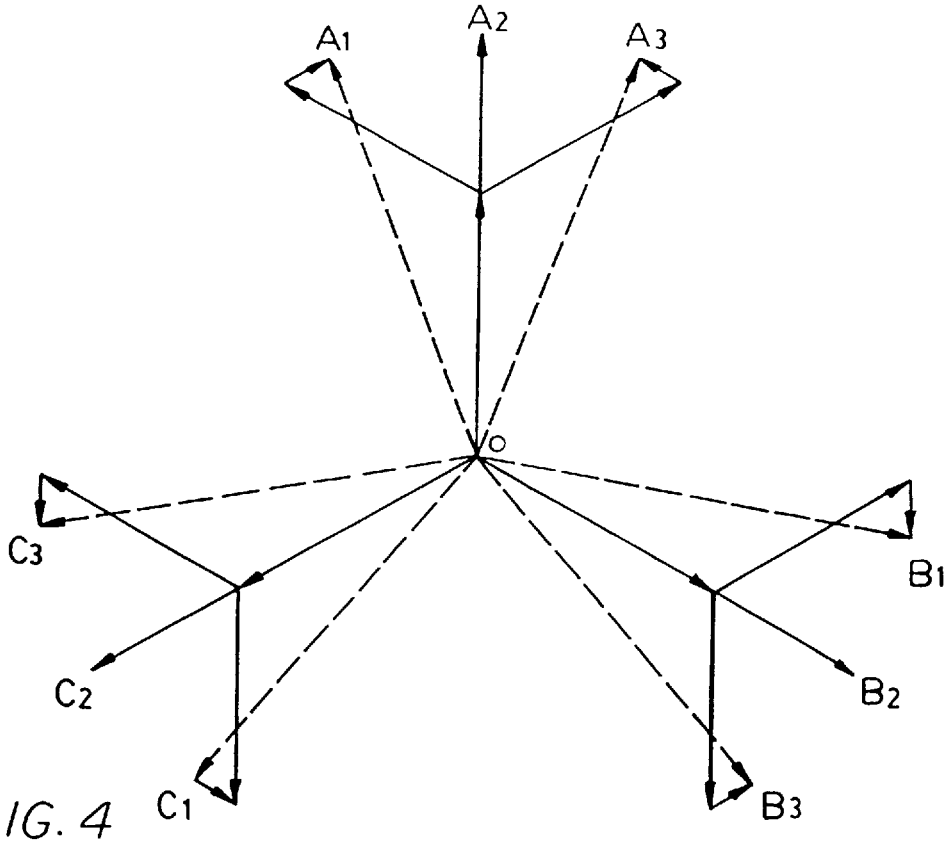
FIG. 4 is a vector diagram illustrating the e.m.f. of a transformer secondary having three 20° phase shifted outputs with low levels of zero phase sequence impedance in the leading and lagging outputs.

FIG. 4 illustrates a further embodiment of the invention having three 20° phase shift angle outputs, with low zero phase sequence impedance on outputs $A_1$, $A_3$, $B_1$, $B_3$, $C_1$ and $C_3$. Thus, for each output $A_1$, $B_1$, $C_1$ and $A_3$, $B_3$, $C_3$ the length of the initial elementary flux vector (oriented in the positive direction) is equal in length to the sum of the lengths of the remaining two flux vectors (oriented in the negative direction) providing low zero phase sequence impedance for these outputs, while for each output $A_2$, $B_2$, $C_2$ the flux vectors are both oriented in the positive direction and the zero phase sequence impedance remains high.

Figure 5:
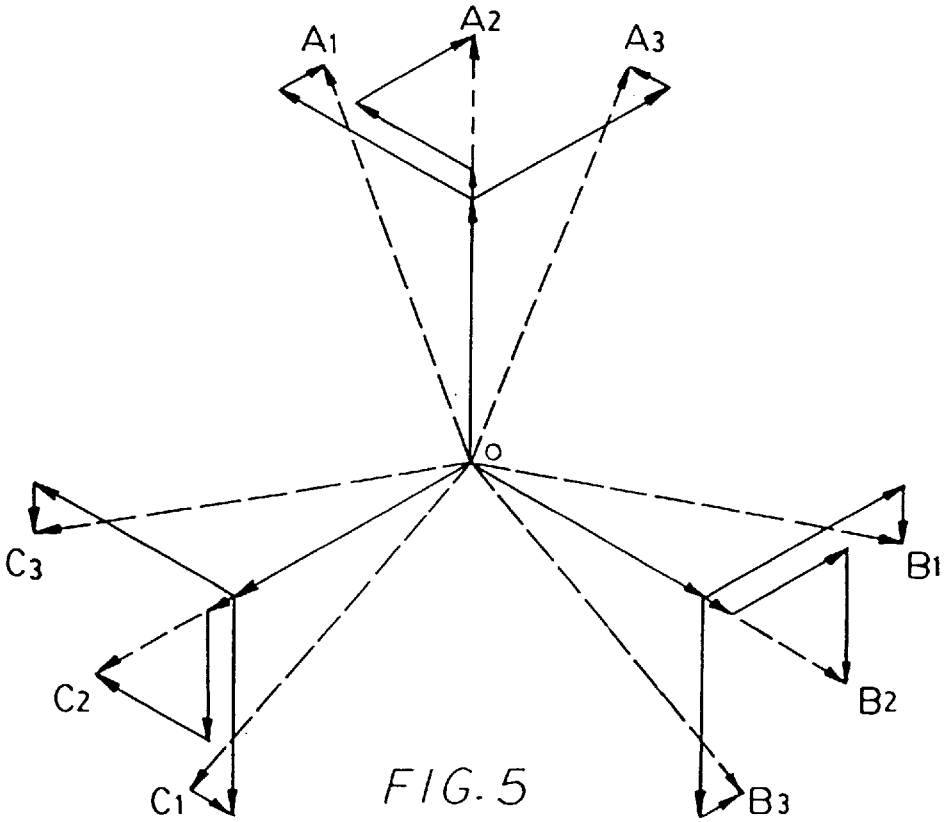
FIG. 5 is a vector diagram illustrating the e.m.f. of a transformer secondary having three 20° phase shifted outputs with each output having a low zero phase sequence impedance.

FIG. 5 illustrates a variation of the transformer of FIG. 4, in which the central outputs $A_2$, $B_2$ and $C_2$ also have a low zero phase sequence impedance. For each output $A_2$, $B_2$, $C_2$ one of the positively oriented flux vectors from FIG. 4 is replaced by two negatively oriented flux vectors. This is accomplished by splitting one of the positively oriented windings for the central outputs $A_2$, $B_2$ and $C_2$ in FIG. 4 into two windings, and disposing these two windings on the other two core legs in a negative orientation. The sum of the lengths of the two negatively oriented flux vectors thus equals the length of the remaining positive flux vector, reducing the zero phase sequence impedance of the outputs $A_2$, $B_2$, $C_2$. This is accomplished by a simple redistribution of windings on the core legs in accordance with the invention, as described above.

It will be appreciated that not all outputs need to have a low zero phase sequence impedance in a transformer or autotransformer of the invention. Only an output in which the total number of turns creating fluxes in the positive direction is equal to the total number of turns creating fluxes in the negative direction will have a low zero phase sequence impedance. The invention can be implemented for all or any number of outputs in a transformer in the manner described above.

The invention having thus been described with reference to a preferred embodiment, it will be apparent to those skilled in the art that certain modifications and adaptations may be made without departing from the scope of invention, as set out in the appended claims.

I claim:

1. A phase shifting transformer or autotransformer for a three-phase power distribution network, comprising three core legs, and for each phase, a secondary winding comprising a plurality of windings electrically connected in series and distributed amongst the core legs, each secondary winding having at least two outputs for connection to one phase of the power distribution network, such that for at least one output each core leg is provided with at least one winding associated with said at least one output, wherein the number of turns of the windings and their placement and orientation on each core leg is such that, for each core leg, the total number of turns generating zero phase sequence flux in the positive direction substantially equals the total number of turns generating zero phase sequence flux in the negative direction.

2. The phase shifting transformer or autotransformer of claim 1 wherein the secondary winding for each phase has two outputs.

3. The phase shifting transformer or autotransformer of claim 2 wherein each core leg is provided with at least one winding associated with each output.

4. The phase shifting transformer or autotransformer of claim 1 wherein the secondary winding for each phase has four outputs.

5. The phase shifting transformer or autotransformer of claim 4 wherein each core leg is provided with at least one winding associated with each output.

6. The phase shifting transformer or autotransformer of claim 1 wherein the secondary windings associated with each output are electrically independent.

7. The phase shifting transformer or autotransformer of claim 1 wherein two or more outputs share a common winding.

8. The phase shifting transformer or autotransformer of claim 1 wherein the secondary winding for each phase has three outputs.

9. The phase shifting transformer or autotransformer of claim 8 wherein each core leg is provided with at least one winding associated with each output.

10. The phase shifting transformer of claim 1 in which each core leg is provided with at least one winding associated with each of a plurality of outputs.

11. The phase shifting transformer of claim 1 in which each core leg is provided with at least one winding associated with each output.

12. A phase shifting transformer or autotransformer for a three-phase power distribution network, comprising three core legs, and for each phase, a secondary winding having at least two outputs for connection to one phase of the power distribution network, each secondary winding comprising a plurality of windings electrically connected in series and distributed amongst the core legs such that for at least one output each core leg is provided with at least one winding associated with said at least one output, wherein the number of turns of the windings associated with said at least one output and their orientation on the core is such that the total number of turns of windings associated with said at least one output generating zero phase sequence flux in the positive direction substantially equals the total number of turns of windings associated with said at least one output generating zero phase sequence flux in the negative direction.

13. The phase shifting transformer or autotransformer of claim 12 wherein the secondary winding for each phase has two outputs.

14. The phase shifting transformer or autotransformer of claim 13 wherein each core leg is provided with at least one winding associated with output.

15. The phase shifting transformer or autotransformer of claim 12 wherein the secondary winding for each phase has three outputs.

16. The phase shifting transformer or autotransformer of claim 15 wherein each core leg is provided with at least one winding associated with each output.

17. The phase shifting transformer or autotransformer of claim 12 wherein the secondary winding for each phase has four outputs.

18. The phase shifting transformer or autotransformer of claim 17 wherein each core leg is provided with at least one winding associated with each output.

19. The phase shifting transformer or autotransformer of claim 12 wherein the windings associated with each output are electrically independent.

20. The phase shifting transformer or autotransformer of claim 12 wherein two or more outputs share a common winding.

21. The phase shifting transformer of claim 12 in which each core leg is provided with at least one winding associated with each of a plurality of outputs.

22. The phase shifting transformer of claim 12 in which each core leg is provided with at least one winding associated with each output.

23. A phase shifting transformer or autotransformer for a three-phase power distribution network, comprising three core legs, and for each phase, a secondary winding comprising a plurality of windings electrically connected and distributed amongst the core legs, the secondary winding associated with at least one phase having at least two outputs for connection to one phase of the power distribution network, said at least two outputs having a phase shift no greater than 30 degrees, such that for at least one of said at least two outputs each core leg is provided with at least one winding associated with said at least one output, wherein the number of turns of the windings and their placement and orientation on each core leg is such that, for each core leg, the total number of turns generating zero phase sequence flux in the positive direction substantially equals the total number of turns generating zero phase sequence flux in the negative direction.

24. The phase shifting transformer of claim 23 in which each phase is provided with 2, 3, 4 or 5 outputs.

* * * * *